US011635282B2

(12) United States Patent
Bernabo

(10) Patent No.: US 11,635,282 B2
(45) Date of Patent: Apr. 25, 2023

(54) IMPACT ACTIVATED CROWD CONTROL MECHANISM AND DEVICE

(71) Applicant: Alejandro Bernabo, Brewster, NY (US)

(72) Inventor: Alejandro Bernabo, Brewster, NY (US)

( * ) Notice: Subject to any disclaimer, the term of this patent is extended or adjusted under 35 U.S.C. 154(b) by 0 days.

(21) Appl. No.: 17/490,331

(22) Filed: Sep. 30, 2021

(65) Prior Publication Data

US 2023/0095113 A1 Mar. 30, 2023

(51) Int. Cl.

| | |
|---|---|
| ***F42C 1/00*** | (2006.01) |
| ***F42C 14/02*** | (2006.01) |
| ***F42B 12/46*** | (2006.01) |
| ***F42B 27/00*** | (2006.01) |

(52) U.S. Cl.

CPC ..... *F42C 1/00* (2013.01); *F42B 12/46* (2013.01); *F42B 27/00* (2013.01); *F42C 14/02* (2013.01)

(58) Field of Classification Search

CPC .... F42C 14/02; F42C 1/00; F42C 1/04; F42C 1/06; F42C 1/08; F42C 1/09; F42C 1/10; F42C 1/12; F42C 1/02; F42B 27/00; F42B 12/46

USPC ..... 124/57, 71, 6, 7; 102/502, 368, 362, 367

See application file for complete search history.

(56) References Cited

U.S. PATENT DOCUMENTS

| | | | | |
|---|---|---|---|---|
| 2,377,207 A * | 5/1945 | Campbell | F42B 27/00 | 102/488 |
| 3,361,065 A * | 1/1968 | Litman | F42B 12/50 | 102/368 |
| 3,795,197 A * | 3/1974 | Levenson | F42B 27/00 | 102/368 |
| H215 H * | 2/1987 | Stewart | 102/487 | |
| 5,481,979 A * | 1/1996 | Walder | F42B 8/12 | 434/11 |
| 6,796,382 B2 | 9/2004 | Kaimart | | |
| 7,322,296 B2 * | 1/2008 | Ellis | F42B 27/08 | 102/482 |
| 8,726,810 B2 | 5/2014 | Kravel | | |
| 9,234,730 B1 * | 1/2016 | Cook | F42C 13/08 | |
| 11,460,280 B2 * | 10/2022 | Thomas | F42B 27/08 | |

(Continued)

FOREIGN PATENT DOCUMENTS

| | | | | |
|---|---|---|---|---|
| FR | 2980567 A1 * | 3/2013 | F42B 12/50 | |
| GB | 2591595 A * | 8/2021 | F41H 13/0081 | |

OTHER PUBLICATIONS

Title: 9440-OC Tear Ball Grenade Author: CSI Combines Systems Item: offer for sale, online catalog Date of Publication: Unknown Published: Online, URL: https://www.combinedsystems.com/product/9440-oc-tear-ball-grenade/#:~: text=9440%20%E2%80%93%20Tear%20Ball%20Grenades%20are,in%20indoor%20and%20outdoor%20situations.

(Continued)

*Primary Examiner* — John Cooper

(57) ABSTRACT

A crowd control method and device are disclosed where the device is of the bursting type and is activated immediately upon impact releasing crowd control chemicals into the surrounding area. The device containing crowd control chemical agents is thrown or tossed into a desired area and is immediately activated upon impact releasing its content. The crowd control chemical agents cause significant discomfort and irritation to the individuals nearby resulting crowds to dispersing.

6 Claims, 1 Drawing Sheet

(56) References Cited

U.S. PATENT DOCUMENTS

| | | | | |
|---|---|---|---|---|
| 2002/0088367 | A1* | 7/2002 | MacAleese | F42B 12/36 102/502 |
| 2007/0266883 | A1 | 11/2007 | Law et al. | |
| 2013/0255525 | A1* | 10/2013 | Silva | F42B 12/40 102/498 |
| 2015/0198428 | A1* | 7/2015 | Tippmann, Jr. | F42B 8/26 102/368 |
| 2016/0273898 | A1* | 9/2016 | Kravel | F42B 27/00 |
| 2018/0292163 | A1* | 10/2018 | Ellis | F42B 12/02 |
| 2020/0333119 | A1* | 10/2020 | Caldwell | F42C 11/065 |
| 2021/0285749 | A1* | 9/2021 | Thomas | F42B 27/08 |

OTHER PUBLICATIONS

Title: Tear Smoke Grenade OC Author: Tearsmoke.org (Tear Smoke Unit) Item: offer for sale, online catalog Date of Publication: Unknown Published: Online, URL: https://tearsmoke.org/grenade/tear-smoke-grenade-oc/.

Title: Duke Pepper Grenades and Sonic Grenades Author: Wolf Security & Tactical Supplies Date of Publication: Unknown Published: Online URL:https://wsts.co.za/index.php/pepper-sprays-grenades/.

Title: Lamperd Pepper Spray Device Author: Lamped Less Lethal Item: offer for sale, online catalog Date of Publication: Unknown Published: Online, URL: https://lamperdlesslethal.com/pepper-blast-devices/.

* cited by examiner

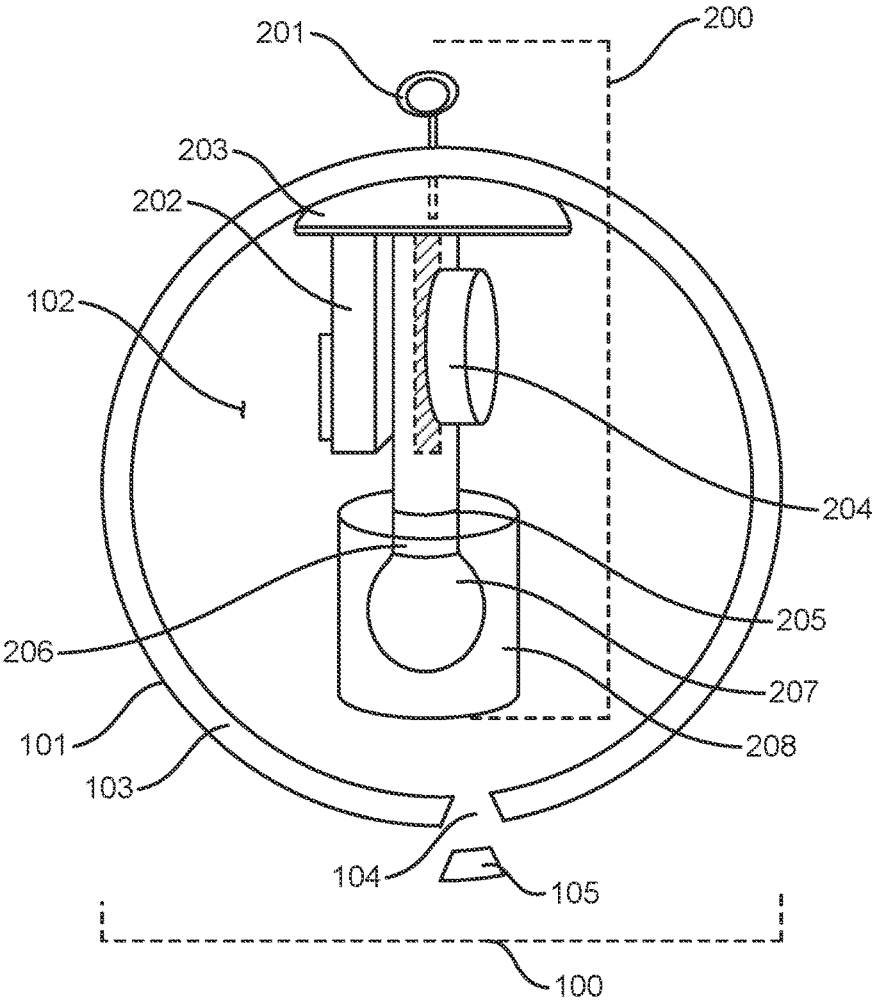
201
200
203
202
102
204
205
206
207
208
101
103
104
105
100

IMPACT ACTIVATED CROWD CONTROL MECHANISM AND DEVICE

FIELD OF THE INVENTION

Embodiments of the present disclosure generally relate to a system and a method for crowd control using an impact activated vessel filled with crowd control chemical agents such that when the vessel is thrown or comes in forceful contact with a surface the content of the device is immediately and equally dispensed into the surrounding areas.

BACKGROUND OF THE INVENTION

Crowd control is a public security practice where large crowds are managed to prevent the outbreak of crowd crushes that can cause fatalities, riots, fights involving drunk and disorderly people and etc. Crowd management, especially effective crowd management is important and helps to ensure the safety of all individuals at any large event or gathering.

Common methods of crowd control include materials such as stanchions, crowd control barriers, fences and decals painted on the ground. At times these common methods of crowd control are insufficient, especially during riots, protests and gathering involving disorderly behavior. Law enforcement personnel historically have used weapons such as batons and whips to disperse crowds and detain rioters. However, since the 1980's, riot control officers began the use of tear gas, pepper spray, rubber bullets and electric tasers as a more effective methods of crowd control. The more novice methods of crowd control employed by law enforcement, including the use of rear gas, pepper spray, rubber bullets and electric tasers are more effective methods than the historical methods, however, they can cause substantial harm and injury to individuals. There is a need for effective crowd control methods that pose very limited physical injury or harm to individuals.

The primary method currently used by law enforcement officers to deliver tear gas, pepper spray or any other non-lethal crowd control chemical is through a capsule that functions and resembles a time delay grenade. The conventional design of a time delay grenade uses a simple chemical delay mechanism where the outer shell holds a chemical fuse surrounded by a reservoir of explosive material. A safety pin is used to hold in place the striker lever on top of the grenade such that the striker lever does not come in contact with the percussion cap igniting the cap creating a small spark activating the internal chemicals. When the pin is removed there is approximately a 4 second delay from when the striker lever comes in contact with the percussion cap creating a small spark leading to the reaction of the grenade and ultimate discharge.

The use of time delay vessels to deliver crowd control chemicals has major disadvantages. For example, the time delay between activation and detonation can vary from 2 to 6 seconds, such that the vessel may become active when still in the possession of the individual especially law enforcement causing harm and injury. Further, the time delay variance can cause the detonation of the capsule in unpredictable areas such as in the air missing the desired target. A prominent drawback is that the time delay allows for counterattacks from the crowd causing harm and injury to law enforcement. Further, the counter-attacker herself can be harmed and injured if the capsule discharges while still in the possession of the counter-attacker. The unpredictability of the time delay delivery of crowd control agents is inefficient, wasteful, and dangerous.

SUMMARY OF THE DISCLOSURE

Various embodiments of the present disclosure are directed to an inventive method and device comprised of an impact activated vessel containing crowd control chemicals.

The object of the invention is to provide an easy and accurate delivery of crowd control agents minimizing injury and harm to individuals. In the current invention the delivery of crowd control chemical agents is impact activated, as opposed to a time delay activation. The impact activation system eliminates many if not all of the drawback associated with a time delay delivery method. The impact activation delivery method and devise significantly reduce, if not eliminate the possibility of the vessel detonating while still in the possession of the deliverer, the possibility of a counter-attack, the possibility of detonation of the vessel while still in the possession of the counter attacker and detonation of the vessel in an unintended and or undesired location.

The general description of the current invention is a vessel preferably in a spherical shape or any shape that lends itself convenient for throwing, with the desired crowd control chemical agent filled inside the capsule and an impact activation mechanism.

To safely store and prevent the vessel from activating from an unintentional impact, a safety mechanism such as a pin or a switch is used. The safety pin or switch blocks unintentional signals from being sent upon impact to the ignition or activation element of the device.

The current invention is intended to be thrown or tossed into a crowd such that when the vessel carrying the crowd control agents comes in contact with a surface with sufficient force, the impact activation system is activated and the vessel immediately upon impact releases crowd control chemical agents into the vicinity.

A person skilled in the art would readily appreciate that the present disclosure may be a basis for modifying or designing other structures for carrying out the same purposes of the present disclosure. Such equivalent constructions do not depart from the teachings of the disclosure as set forth in the present specification and claims. The novel features, which are believed to be characteristic of the disclosure, both as to its organization and method of operation, together with further purposes and advantages, will be better understood from the following description.

BRIEF DESCRIPTION OF THE DRAWINGS

A person skilled in the art would appreciate that these FIGURES are provided for the purposes of illustration and description only and are not intended to act as limits of the present disclosure.

FIG. 1 is a schematic diagram according to an exemplary embodiment of the present disclosure displaying the elements of the vessel and the impact activation system.

DETAILED DESCRIPTION OF THE PREFERRED EMBODIMENTS

The following description is not to be interpreted or applied in a limiting sense, but as an illustration of the general principles and aspects of the invention. The breadth and scope of the present inventions are set forth by the claims. Various inventive features are described below that can each be used independently of one another or in combination with other disclosed and undisclosed features.

FIG. 1 depicts an embodiment of the present disclosure. The device of the present invention is a vessel (100) that is meant to be filled with crowd control chemicals into the internal cavity (102) and tossed into a crowd such that when the vessel (100) encounters a surface, the impact activation system (200) is activated sending a signal to the cold igniter (207) activating the pyrotechnics (208) causing a burst and the release of the internal contents of the vessel.

The device of the present invention is safely maintained and stored with a use of a safety pin (201) inserted into the top unit (203) of the activation portion of the device. The safety pin (201) prevents the communication of a shock signal from the shock triggering circuit (202) to the cold igniter (207) such that when the pin is inserted even if the vessel is thrown or tossed it does not react or activate. Instead of the safety pin (201) other safety methods of can be utilized such as a safety trigger that can manually be turned on and off, an electronic button used to turn the device on and off, or other equivalent methods of controlling communication of a shock signal from the shock triggering circuit (202) to the igniter (207).

When the capsule is to be used, the pin (201) is removed allowing the impact activation mechanism (200) to switch on such that when the capsule is thrown or tossed, the shock triggering circuit (202) sends a signal via electric wires traveling through the spine (205) which is enclosed by a plastic capsule (206) leading to the cold igniter (207) causing the cold igniter (207) to ignite the surrounding pyrotechnics (208). As the surrounding pyrotechnics (208) are activated or sparked a burst occurs which is followed by an immediate release of the crowd control agents stored inside the internal cavity (102) into the surrounding areas. The process described above from the shock triggering circuit (202) sensing the impact and forceful bursting of the vessel (100) occurs under a second.

In the preferred embodiment the impact activation system (200) is composed of the pin (201), the top unit with a safety trigger (203), a shock triggering circuit (202), a button cell battery (204), the spine (205) enclosed by a plastic enclosure (206), a cold ignitor (207) and surrounding pyrotechnics (208). The pin (201) is used to prevent unnecessary activation of the device. The top unit (203) holds the pin (201) in place or any switch used to turn the device on or off, the shock triggering circuit (202), the spine (205) with its surrounding plastic enclosure (206) and the button cell battery (204) together. The shock triggering circuit (202) is responsible for sensing the shock or impact experienced by the device and sending the signal out to the cold igniter (207). The button cell battery (204) provides the necessary power for the for the signal to travel from the shock triggering circuit (202) to the cold igniter (207) and provides the necessary voltage for activation of the cold ignitor (207). The spine (205) carries the shock signal from the shock triggering circuit (202) to the cold igniter (207). The spine (205) is enclosed via a plastic enclosure (206) to protect the internal mechanism and the safe relay of the signal from the shock triggering circuit (202) to the cold igniter (207). The cold igniter (207) ignites the surrounding pyrotechnics (208) causing a forceful burst and the release of contents stored inside the internal cavity (102) of the vessel (100) into the surrounding areas.

In the preferred embodiment the impact activation system (200) is placed inside the vessel (100) such that the top unit (203) of the impact activation system (200) is hedged at one end of the device and the cold igniter (207) with the pyrotechnics (208) does not reach the bottom of the vessel (100) and is effectively suspended in the internal cavity (102) of the vessel (100).

In the preferred embodiment the vessel (100) is a sphere which allows equidistant distribution of the content around an impact area. However, the vessel (100) can be an oval shaped, pin shaped, hourglass shaped, egg shaped, football shaped, tube shaped, a sphere box and any other shape that allows the vessel to be effectively and accurately thrown into a desired location.

In the preferred embodiment, the device is intended for single use such that the content inside the cavity (102) is dispersed, and the capsule material or casing (103) is fully disseminated. In such instances, it is preferred that the casing (103) of the device be made of light weight material such that when casing is disseminated into its surroundings it does not cause harm or injury to those in close proximity.

In the preferred embodiment the casing (103) is composed of a lightweight material such as rigid plastic foam. However, other similar materials can be used such as quantum foam, polyurethane foam (foam rubber), XPS foam, polystyrene, phenolic or many other manufactured foams, PLA lined paper products, bagasse, molded fibers and etc. Further, the outside cover (101) is meant to enclose and securely hold the vessel together and is usually made of heat shrink material, however equivalent materials can be used to securely enclose the vessel (100) including but not limited to elastomeric tubes, fluorinated ethylene propylene (FEP), polyolefin, PVC, polyvinylidene fluoride, silicone rubber, PTFE and Viton.

In the preferred embodiment the internal cavity (102) is already pre-filled with the crowd control chemicals. However, the casing (103) of the vessel (100) can be made with a filler opening (104) such that crowd control chemicals of choice (102) can be filled inside the internal cavity and securely closed by a cap (105). These chemicals, powders and liquids that can be used include and are not limited to PAVA powders which are also known as capsaicin powders which are usually derived from chili peppers, CS powder with the chemical composition of 2-chlorobenzylidene malononitrile, tear gas which has the chemical composition of 0-chlorobenzylidene malononitrile, 2-chloroacetophenone also known as mace, military-grade putricant also known as a stink-bomb and any combination thereof. Further, the vessel (100) can be composed of various compartments within the cavity, with corresponding openings into the cavity, such that different substances can be filled into each of the compartments without mixing with one another.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A crowd control device comprising:

a vessel;

crowd control chemical agents contained inside the vessel;

an impact activation system;

a safety mechanism preventing unintended activation of the device; and is for single disposable use such that when activated the outer casing, the impact activation system and the internal material dissociate into the vicinity.

2. The crowd control device of claim 1, where the vessel is a sphere.

3. The crowd control device of claim 1, wherein the crowd control chemical agents are selected from capsaicin, 2-chlorobenzylidene malononitrile, 0-chlorobenzylidene malononitrile, and 2-chloroacetophenone.

4. The crowd control device of claim 1, wherein the safety mechanism is a pin.

5. A method of crowd control comprising:

providing a crowd control devise intended for single use, comprising a lightweight outer casing made of rigid plastic foam filled with crowd control chemical agents and an impact activation system that sends a signal to the ignition portion of the device activating the device upon impact; and activating the device upon impact such that the contents of the device are dispensed into the vicinity disrupting the outer casing.

6. The method of crowd control of claim 5, where the container is made of material including quantum foam, polyurethane foam, XPS foam, polystyrene, phenolic manufactured foams, PLA lined paper products, bagasse, and molded fibers.

* * * * *